United States Patent [19]

Dubinsky et al.

[11] 4,289,192

[45] Sep. 15, 1981

[54] METHOD AND APPARATUS FOR PRODUCING A SOLID-SECTION INGOT BY ELECTROSLAG REMELTING

[76] Inventors: Rudolf S. Dubinsky, ulitsa Politekhnicheskaya, 5, kv. 209; Boris I. Medovar, ulitsa Anri Barbjusa, 22/26, kv. 109; Georgy A. Boiko, ulitsa Vladimiro-Lybedskaya, 16, kv. 106, all of Kiev, U.S.S.R.

[21] Appl. No.: 31,485

[22] Filed: Apr. 19, 1979

[51] Int. Cl.[3] ..... B22D 27/02

[52] U.S. Cl. ..... 164/470; 164/154; 164/509

[58] Field of Search ..... 164/52, 252, 122, 125–128, 164/60, 348; 13/9 ES; 75/10 R, 10 C

[56] References Cited

U.S. PATENT DOCUMENTS 2,380,238 7/1945 Hopkins ..... 164/52
2,388,974 11/1945 Hopkins ..... 164/52

FOREIGN PATENT DOCUMENTS 2292773 6/1976 France ..... 164/252
52-16425 2/1977 Japan ..... 164/52

*Primary Examiner*—Robert D. Baldwin
*Assistant Examiner*—K. Y. Lin
*Attorney, Agent, or Firm*—McAulay, Fields, Fisher, Goldstein & Nissen

[57] ABSTRACT

The method includes remelting consumable electrodes in a melting container and effecting a positive action upon crystallization of the ingot in the course of the melting operation, consisting in that a cooled body is brought into contact with the molten metal constituting the metal bath and the contact is maintained till the melting operation is complete by moving the cooled body at a speed close to the melting rate. On completion of the melting operation, the cooled body is extracted from the metal bath. The cooled body may be made in the form of a float or of an extension widened at the bottom and fixedly attached to a movable mold.

14 Claims, 12 Drawing Figures

13
10
18
16
5
14
23
31
22
26
29
27
17
30
24
4
9
25
28
8
22
32
21
a
12
15
2
h
6
20
11
1
7
3
19

13
10
18
16
5
14
8
34
17
12
37
35
33
4
2
32
a
15
9
h
36
6
7
1
3
19

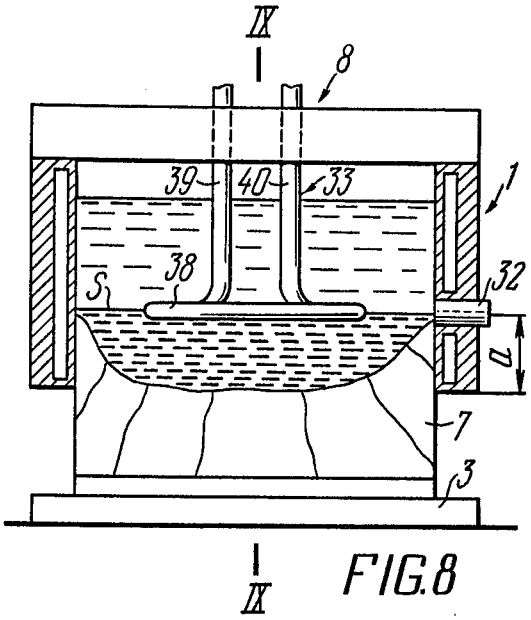
FIG.8
FIG.9
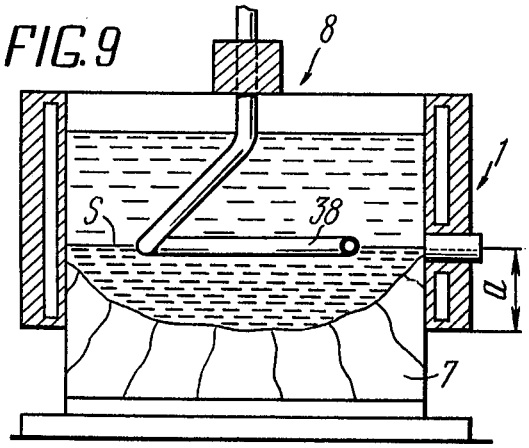

METHOD AND APPARATUS FOR PRODUCING A SOLID-SECTION INGOT BY ELECTROSLAG REMELTING

BACKGROUND OF THE INVENTION

1. Field of the Invention

The present invention relates to the art of electrometallurgy and is specifically concerned with a method and apparatus for the electroslag remelting process.

The invention is particularly applicable to producing large ingots.

The term "melting operation", as used throughout the specification and claims means the process of making one ingot by the electroslag remelting method.

The term "melting rate" is used to suggest the rate of molten metal accumulation in a melting container in the course of electroslag remelting of one or more consumable electrodes, expressed through the linear speed of movement of the metal bath surface along the height of the melting container.

The term "metal bath depth" is used to suggest the distance from the metal bath bottom, i.e. the solid-liquid interface in the ingot, to the metal bath surface, measured along the vertical axis of symmetry of the melting container at the time moment under consideration.

2. Description of the Prior Art

When making a large solid-section ingot by the electroslag remelting process, it is difficult to attain a compact fine-grained metal structure throughout the ingot volume, since in the course of crystallization due to decline in the cooling effect of the bottom plate with the increase in height, the center portion of the metal bath deepens considerably as the ingot grows, and the bath bottom acquires the shape of a deep steep-sided funnel; this favors development of segregation effects and entrapment of non-metallic inclusions in the center portion of the ingot.

Various attempts to control crystallization in the process of ingot making by exposing the metal bath to an electromagnetic field, ultrasound oscillations, or mechanical vibration which ensure breakdown of large crystals in the course of their growth have been undertaken for levelling the metal bath bottom with the aim of obtaining a sound metal structure.

However, said methods yield a stable effect only in making ingots of not more than 1000 mm in diameter and 2.5 m in height. Applying the methods for larger ingots entails great power losses and fails to yield any adequate results.

There has recently been developed a power modulation technique employed in particular in the method for producing an ingot by electroslag remelting, disclosed in U.K. Pat. No. 1,421,393, Class H2H, 1976.

This method contemplates connecting each electrode or an electrode group to a separate power source. After steady-state remelting conditions have been attained, the current and voltage fed to each electrode or to each electrode group are alternately decreased and increased so that the power of the current supplied alternately reaches the maximum and the minimum. This procedure provides for recurrent-progressive or reciprocating motion of the maximum heat point in the slag bath, which allows a homogeneous, compact, and fine-grained structure or remelted metal to be obtained.

The above method is applicable for large-section ingots, but yields a marked effect only with relatively short ones. Besides, its application is confined to a multi-electrode apparatus.

The method calls for cumbersome, complicated, and costly equipment including several power sources, means for switching these, a large number of current leads interfering with access to the working elements of the apparatus and causing considerable electric power losses.

Well known in the art are electroslag remelting apparatus for producing hollow ingots, which provide for a sound metal structure owing to the presence in the melting container of a cooled body needed to form a hollow in the ingot.

There has been provided, for example, an electroslag remelting apparatus for making hollow ingots, comprising a cooled body in the form of a molding core, linked to a lifting device, in a melting container formed by a mold and a bottom plate (see, e.g., U.S. Pat. No. 3,807,487, Class 164–252, 1974).

In a similar apparatus with a movable mold resting in its lowermost position on a bottom plate to form therewith a melting container, the core is linked to the lifting device not directly but through the movable mold coupled with the lifting device, the core being fixedly attached to the mold (see B. E. Paton, V. R. Demchenko et al. "Matematicheskoe opisanie protsessa zatverdevania pologo elektroshlakovogo slitka" in "Rafinirujuschie pereplavy", edited by B. E. Paton, Member of A. Sc. of the USSR, No. 2, p. 35, FIG. 2; Kiev, 1975).

The core in the above apparatus is provided with supporting members allowing the core to be secured to the top end face of the movable mold and with an extension projecting downwardly from the end face for a length exceeding that of the movable mold.

The apparatus of the above type also generally comprises a liquid metal level detector which is arranged in the wall of the movable mold for producing commands which provide the controls for controlling the vertical movement of the movable mold in accordance with the movement of the slag-metal interface relative to the detector operation.

The above-described apparatus are unfit for making solid-section ingots, since the cooled body (core) is arranged therein so as to prevent the molten metal of consumable electrodes from penetration into the core location zone when the core is moved, with the result that a hollow is formed in the ingot.

A considerable core-to-molten slag contact area results in great heat losses in the apparatus and hence in an additional power consumption.

SUMMARY OF THE INVENTION

The principal object of the invention is to provide a simple and economically efficient method for producing solid-section ingots by electroslag remelting, ensuring a compact fine-grained metal structure throughout the whole ingot volume with any size of ingot.

Another object of the invention is to provide an electroslag remelting apparatus for producing ingots, which accomplishes said method with minimum electric power consumption.

These objects are accomplished in a method for producing a solid-section ingot by electroslag remelting of one or more consumable electrodes in a melting container with formation of a metal bath moving upwardly as the ingot grows, including effecting a positive action upon ingot crystallization in the course of the melting operation wherein, according to the invention, said action is accomplished by bringing a cooled body into contact with the molten metal constitutig the metal bath so that said cooled body is disposed on the vertical axis of symmetry of the melting container and by maintaining this until the melting operation is completed by moving said cooled body upwardly at a speed close to the melting rate, with subsequent extraction of said cooled body from the metal bath.

Introduction of the cooled body into the central portion of the ingot metal bath speeds up the crystallization process in this zone and promotes the levelling of the metal bath bottom which is the solidified front, creating thereby the conditions for unidirectional growth of crystals and formation of a fine-grained compact structure throughout the ingot volume.

Said operation involves no considerable power consumption and calls for no complicated equipment for its accomplishment.

It is expedient that the cooled body be brought into contact with the molten metal bath prior to the moment when sections inclined to a horizontal line at an angle of 45° are formed in the profile of the metal bath bottom and when such sections appear within the zone, transverse dimensions thereof on the metal bath surface amount to not less than 75% of this surface. Said zone is normally symmetrical with respect to the vertical axis of symmetry of the melting container.

The above condition provides for the optimum direction of crystal growth in the central portion of the ingot. Introducting the cooled body at a later stage of the melting operation may bring about the appearance in the ingot of zones, wherein the direction of crystal growth makes an angle of over 75° with a vertical line, which entails emergence of aggregations of nonmetallic inclusions, deteriorating the ingot strength.

To ensure homogeneity of the ingot structure, it is essential that the depth of immersion of the cooled body into the metal bath amount to not more than 60% of the bath depth at the moment preceding the immersion of the cooled body.

This depth may be achieved the moment the cooled body is immersed into the metal bath, or after the cooled body immersed into the bath has been momentarily thrust against the bath bottom and moved upwardly to the predetermened level at a speed exceeding the melting rate.

Inasmuch as a crust of solidified metal is formed on the cooled body surface and the direction of crystal growth of the crust is opposite to that of the crystals of the ingot bulk, a small distance between the cooled body and the metal bath bottom may result in that the thickness of the molten metal interlayer will be insufficient to melt down said crust.

It is to be noted that introducig the cooled body into the metal bath causes the profile of the bath bottom to change which may be accompanied by a shallowing of the bath.

Immersing the cooled body to a depth exceeding the above-specified one may give rise to emergence in the ingot of zones with multidirectional crystallization and, as a consequence, of discontinuities in the metal structure.

The objects of the invention are also accomplished in an electroslag remelting apparatus for producing a solid-section ingot, adapted to carry out the above-described method and comprising in a melting container, formed by a mold and a bottom plate, a cooled body disposed on the vertical axis of symmetry of said container and connected to a lifting device, wherein, according to the invention, said cooled body is a float whose weight is heavier than that of the molten slag having a volume equal to that of the float and lighter than that of the molten metal having the same volume.

The construction of the above apparatus enables solid-section ingots with a compact fine-grained structure throughout the volume to be obtained, while the construction of the cooled body allows for its self-positioning in the metal bath and for maintaining a constant depth of its immersion into the bath.

With an appropriate configuration of the float, when the surface area of its portion projecting above the metal bath surface is small and its inner space to be filled with a cooling fluid is offset downwardly, the area of its contact with the slag bath can be minimized to reduce the heat losses due to the presence of the cooled body in the melting container.

The cooled body has supporting members secured to the top end face of the movable mold, and an extension projecting in the downward direction from said end face by a length less than the height of the movable mold. The extension of the cooled body comprises a wide portion disposed below the level of liquid metal level detector location, a narrow portion disposed above said wide portion, and an intermediate portion whose surface is shaped close to a cone, and conjugates said narrow and wide portions, thereby providing for flow of molten metal drops down from the cooled body surface. The cooled body can also be defined by a pipe grating.

The extension of the cooled body can be shaped as a coil, and said coil can be a pipe bent to form a loop. Such pipe includes a horizontal portion where said pipe is bent circle-wise, and vertical inlet and outlet portions, disposed symmetrically with respect to the vertical axis of symmetry of the melting container, the horizontal plane of symmetry of the horizontal portion of the loop being disposed not lower than the level of the liquid metal level detector location, thereby excluding the possibility of freezing the cooled body to the crystallizing metal.

The float may be provided with a counterweight to control the depth of its immersion into the metal bath, which ensures the optimum conditions for maintaining the cooled body in contact with the molten metal constituting the metal bath under different conditions of the melting operation and with different chemical composition of the ingots produced.

The float and counterweight may be mounted on opposite ends of a two-arm lever installed above the mold for rocking with respect to the latter.

The objects of the invention are also accomplished in an electroslag remelting apparatus for producing a solid-section ingot intended to carry out the above-described method and comprising in the melting container, formed by a bottom plate and a movable mold in the lowermost position thereof, a cooled body having supporting members secured to the top end face of the mold and an extension projecting downwardly from said end face, and comprising also a lifting device for moving the movable mold and a liquid metal level detector connected with said lifting device and installed in the movable mold wall, wherein, according to the invention, the cooled body extension is of a length less than the height of the movable mold and inludes a wide portion disposed below the level of the liquid metal level detector location, a narrow portion disposed above said wide portion, and an intermediate portion whose surface is shaped similar to a cone and conjugates the narrow portion and the wide portion, providing thereby for flow of molten metal drops down from the cooled body surface.

The construction of the above-described apparatus provides for producing therein solid-section ingots with a compact fine-grained structure throughout the whole ingot volume. The relative dimensions of the cooled body extension and the movable mold are such that said extension does not interfere with filling by molten metal of the space previously occupied by the extension and then left by the latter due to its movement. The shape of the extension, narrow in its upper portion and wide in its lower portion, provides for the optimum contact with the molten metal and at the same time, owing to a reduced extension-to-slag bath contact area, cuts down the power losses caused by the presence of the cooled body in the melting container.

The above-described apparatus is simple in construction. Inasmuch as the cooled body is not a molding element and no stringent requirements as to strength are placed upon it, it is advantageous that it be as light as possible and have the form of a pipe grating or coil.

The coil may be a pipe bent in the form of a loop.

With a circular cross-section mold, such a loop may include a horizontal portion where said pipe is bent substantially circlewise, and vertical inlet and outlet portions disposed symmetrically with respect to the vertical axis of symmetry of the melting container. In this case it is essential that the horizontal plane of symmetry of the horizontal portion of the loop be disposed not lower than the level of the liquid metal level detector location to exclude the possibility of freezing the cooled body to the crystallizing metal of the ingot.

BRIEF DESCRIPTION OF THE DRAWINGS

The invention will now be explained with reference to particular embodiments thereof taken in conjunction with the accompanying drawings, wherein:

FIGS. 4–9 illustrate variously shaped modifications of the cooled body in the apparatus shown in FIG. 3;

FIG. 4, in the form of a grating made up of pipes;

FIG. 5, in the form of a helical coil;

FIG. 6, in the form of a pipe bent into a loop;

FIG. 7 is a sectional view taken along the line VII—VII in FIG. 6;

FIG. 8 in the form of a pipe bent into a loop having a horizontal portion and vertical portions;

FIG. 9 is a sectional view taken along the line IX–IX in FIG. 8;

a—for a 1100-mm-diameter cylindrical ingot;

b—for a 2700-mm-diameter cylindrical ingot;

c—for a 250×1100-mm rectangular cross-section ingot.

DETAILED DESCRIPTION OF THE INVENTION

A method for producing a solid-section ingot by electroslag remelting is as follows.

Figure 1:
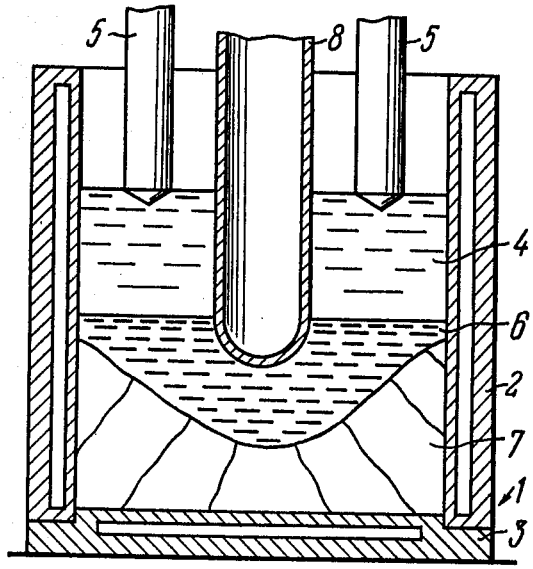
FIG. 1 is a diagram illustrating the principle of the method for producing a solid-section ingot by electroslag remelting according to the invention.

A slag bath 4 (FIG. 1) is established in a known manner in a melting container 1 formed by a mold 2 and a bottom plate 3. Consumable electrodes 5 are immersed into the slag bath and fed with electric current. Acted upon by the current, the slag bath 4 heats up and melts the consumable electrodes 5. Drops of liquid metal from the ends of the consumable electrodes 5 flow down onto the bottom plate 3, forming a metal bath 6. The molten metal constituting the metal bath 6 cools down and crystallizes at the cooled walls of the mold 2 and in the immediate vicinity of the cooled bottom plate 6. The crystallized metal forms the bottom of the metal bath 6. The effect of the cooled bottom plate 3 declines with height of the melting container 1, while the effect of the cooled walls of the mold 2 remains unchanged. As a result, the bottom profile of the metal bath 6 changes as the ingot grows: the center of the bottom starts deepening and the bottom tends to acquire the shape of a conical funnel. As soon as the first symptoms of such a change appear, a cooled body 8 is brought into contact with the molten metal constituting the metal bath 6.

The change in the bottom profile of the metal bath 6 in the course of ingot making is determined experimentally or with the use of theoretical calculations before starting the melting operation. The experimental determination consists in that a test ingot is made beforehand in the same melting container without immersing the cooled body therein but under the specified melting operation conditions, following which the process of change in the metal bath bottom profile is found out from the directon of crystal growth on the longitudinal section of the test ingot and the optimum moment for immersing the cooled body and the possible depth of its immersion are determined on this basis.

The theoretical determination of the metal bath bottom profile at different moments of the melting operation involves plotting the liquidus isotherms calculated by the known procedure (see B. E. Paton, V. F. Demchenko, Ju. G. Emeljanenko, D. A. Kozlitin, V. I. Machnenko, B. I. Medovar, Ju. A. Sterenbogen. "Investigation of Temperature Fields of Large Electroslag Remelted Ingots by the Methods of Mathematical Simulation" in "Special Electro-Metallurgy", Part 1—Reports of the International Symposium on Special Electrometallurgy, Kiev, June 1972, Naukova Dumka Publishers, Kiev, 1972, pp.144–154).

In determining the amount of bringing the cooled body 8 into contact with the molten metal, both the demands placed upon the quality of the ingot produced and the economical efficiency, technical feasibility, and safety of the ingot making process are taken into consideration. On the one hand, from the standpoint of obtaining a sound ingot metal structure, as well as for simplicity of construction and safety of the melting operation, it is preferable that the cooled body be immersed into the molten metal at an early a stage of the ingot making process as possible, while on the other hand, since the presence of a cooled body in the slag bath inevitably calls for an increase in power consumption to compensate for the heat losses caused thereby, it is advisable to bring the cooled body into contact with the molten metal at the latest stage of the process as possible.

The governing factor in deciding this point consists in that the angle between the direction of crystal growth and a vertical line must not exceed 45'; this is a prerequisite for producing a high quality ingot, since exceeding this angle entails such a defect of ingot macrostructure as entrapment of nonmetallic inclusions between the crystals in the ingot central zone.

The depth of immersion of the cooled body 8 into the metal bath 6 is based on the following considerations.

A too deep immersion of the cooled body 8 into the metal bath 6 results in that crystals growing towards the bottom of the metal bath 6 start forming on the cooled body surface. Intergrowth of these with the crystals growing from the bottom of the metal bath 6 may give rise to such defects as cavities, non-metallic inclusions, etc. in the center portion of the ingot.

To avoid such undesirable effects, the cooled body 8 is immersed into the metal bath 6 for not more than 60% of the initial depth of the bath, i.e. of its depth immediately before the immersion. This condition ensures that the crystals emerging on the surface of the cooled body as it contacts the metal bath 6 melt down in a shorter time than that needed for their intergrowth with the crystals growing from the bottom of the metal bath 6.

According to an alternative embodiment of the invention, the cooled body 8 is immersed into the metal bath 6 till it momentarily thrusts against the bath bottom and is then lifted to the predetermined depth, which also must not exceed 60% of the initial metal bath depth, at a speed greatly exceeding the melting rate. This technique enables the depth of bath 6 immediately at the moment of immersing the cooled body 8 in the course of the melting operation to be determined, eliminating at the same time the possibility of the above-described effects associated with a location of the cooled body 8 close to the bottom of the metal bath 6.

The cooled body 8 is maintained in contact with the molten metal till the melting operation is complete by moving the cooled body 8 upwardly at a speed close to the melting rate, following which the cooled body is extracted from the bath 6.

The cooled body 8 is generally moved at a speed equal to the melting rate, but modifications with either a higher or a lower speed are possible in principle.

The difference between the speed of movement of the cooled body 8 and the melting rate is restricted by the condition that the position occupied by this body in the metal bath 6 must lie between the bath surface and the critical depth whereat the above-mentioned intergrowth of oppositely growing crystals takes place.

It is reasonable to expect that the optimum action upon the bottom profile of the metal bath 6 would be exerted by the cooled body 8 progressively moved in the course of the melting operation period from the metal bath surface to the maximum possible immersion depth, for which purpose the speed of moving the cooled body upwardly would have to be selected less than the melting rate. By appropriately varying the ratio between the melting rate and the speed of the cooled body it would be possible to provide for a stable bottom profile and for a stable depth of the metal bath 6 during the whole melting operation. This modification of the method according to the invention, however, is difficult to realize at present because of the fact that behavior of the solidified front in the ingot in the presence of a cooled body inside the metal bath depends upon a great many factors, and extensive theoretical and experimental efforts are needed to predict the behavior.

The simplest for engineering realization, as well be demonstrated hereinafter by way of two electroslag remelting apparatus for producing ingots, has proved to be the abovedescribed modification of the method according to the invention, including immersing a cooled body in the metal bath and subsequent movement of the cooled body at a speed equal to the melting rate.

Figure 2:
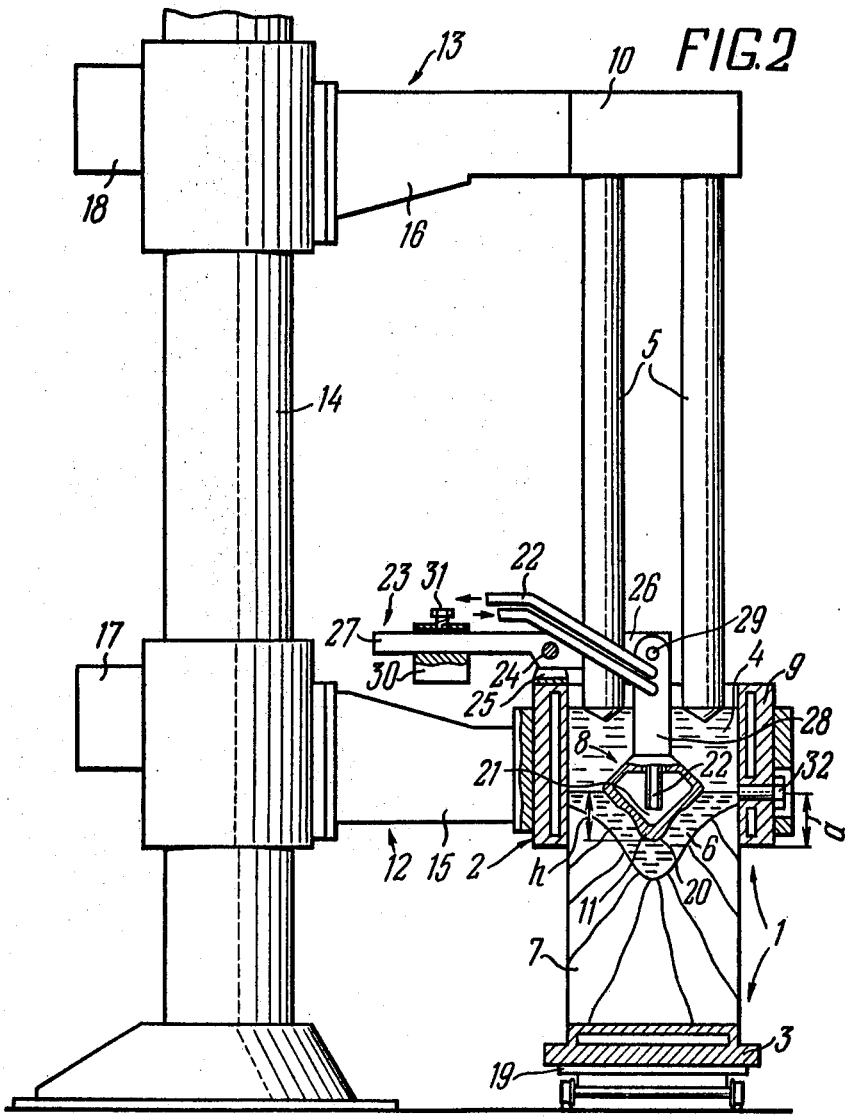
FIG. 2 is a partially cut-away diagrammatic view of an electroslag remelting apparatus for producing an ingot according to the method of the invention.

FIG. 2 illustrates an electroslag remelting apparatus for producing ingots, comprising a mold 2 which is movable and has walls 9 defining an inner space open at the top and bottom ends of the mold, a bottom plate 3 adjoining the bottom end of the mold 2 when the latter is in its lowermost position and forming therewith a melting container 1, an electrode holder 10 adapted to hold consumable electrodes 5 and disposed above the melting container 1, and a cooled body 8 made in the form of a float 11.

The apparatus incorporates two lifting devices 12 and 13 mounted on a vertical column 14 installed close to the melting container 1.

The lifting devices 12 and 13 are adapted to move the mold 2 and the electrode holder 10, respectively, in the course of the melting operation and are made in the form of carriages 15 and 16 mounted for axial movement on the vertical column 14 and provided with drives 17 and 18. The carriage 15 carries the mold 2, and the carriage 16 disposed above the carriage 15 carries the electrode holder 10.

The bottom plate 3 of the melting container 1 is mounted on a truck 19 intended to remove a finished ingot on completion of the melting operation. The cross-sectional configuration of the float 11 is similar to that defined by walls 9 in the cross-section of the mold 2.

The float 11 has at its bottom a pointed tip 20 to bear against the bottom plate 3 at the initial moment of the melting operation. An enclosed inner space 21 in the float 11 communicates through pipes 22 with a cooling fluid feed system (not shown).

The float 11 is carried by a two-arm lever 23 disposed above the mold 2. A pivot pin 24 of the lever 23 is fitted in a yoke 25 attached to the mold 2 on the outside so that a first arm 26 of the lever is disposed substantially in the zone over the mold 2, and a second arm 27, beyond this zone.

The float 11 suspended on a hinge pin 29 from an end of the first arm 26 of the lever 23 with the aid of a bar 28 rigidly secured to the float is arranged on the vertical axis of symmetry of the melting container 1. The second arm 27 of the lever 23 carries a counterweight 30 movable along the arm 27 and fixed in the required position thereon by a screw 31 fitted in a threaded hole in the counterweight 30 and thrusting against the body of the arm 27. Inasmuch as the mold 2 is operatively connected with the lifting device 12, connection of the pivot pin 24 of the lever 23 to the mold 2 provides for linking the float 11 to the same lifting device 12, which is necessary to remove the float 11 from the ingot metal bath on completing the melting operation.

The wall 9 of the mold 2 accommodates a liquid metal level detector 32 electrically connected with the drive 17 of the carriage 15 of the lifting device 12 and intended to control the movement of the mold 2. The detector 32 is disposed at a height a from the bottom plate 3, which height is hereinafter referred to as the level of the detector location (the height a is shown from the lower end of the mold 2).

Before the melting operation is started, the float 11 bears against the bottom plate 3 by the tip 20 under the action of the float gravity.

The float gravity is to be understood as a force acting vertically down the axis of symmetry of the float, which force in the modification under consideration is conditioned by the difference of the moments of the weight of the float 11 and of the weight of the counterweight 30 with respect to the pivot pin 24 of the lever 23. The difference must be greater than the weight of the molten slag having a volume equal to that of the float 11, but less than the weight of the molten metal having the same volume. The above condition is required for the float 11 to sink in the molten slag, but to keep afloat in the molten metal.

On establishing the slag bath 4, the ends of the consumable electrodes 5 are lowered thereinto, and the melting operation is started. The molten metal accumulates on the bottom plate 3 to form the metal bath 6. As soon as the buoyancy force created by the molten metal exceeds the weight of the float 11, the latter floats up. The depth h of float immersion in the floating state is adjusted beforehand by shifting the counterweight 30 along the arm 27 of the lever 23. As the molten metal level in the melting container 1 rises, the float 11 moves together with the metal bath 6. When the bath surface reaches the level a of the liquid metal level detector 32, the latter operates to actuate the drive 17 of the carriage 15, and the mold 2 starts moving upwardly carrying with itself the lever 23 with the float 11. After the melting operation has been completed, the carriage 15 with the mold 2 continues for some time moving at a speed equal to the melting rate til the moment when the mold 2 comes outside the fully solidified ingot; the float 11 moving ahead of the bottom end of the mold leaves the metal bath before the latter has time to cool down. When changing over from making ingots of one chemical composition to making those of another chemical composition, as well as when changing the melting operation conditions, the depth h of immersion of the float 11 can be readjusted with the aid of the counterweight 30.

The above-described construction of the electroslag remelting apparatus for producing an ingot, comprising a cooled body in the form of a float does not represent the only possible embodiment of the invention.

It is to be noted that said principle is also applicable to large apparatus with a stationary mold. A lifting device operatively connected with the float at the final stage of the melting operation should be specially provided for the purpose of removing the float out of the metal bath in this case. Individual units of the apparatus may be variously otherwise constructed. For example, the float gravity may be adjusted by the use of removable elements provided on its body. The coupling of the float to the melting container may have the form of guides restricting its transverse movements, while the coupling to the lifting device may be accomplished by means of catchers provided for the purpose. Other modifications based on combinations of devices known in the art are also possible.

Figure 3:
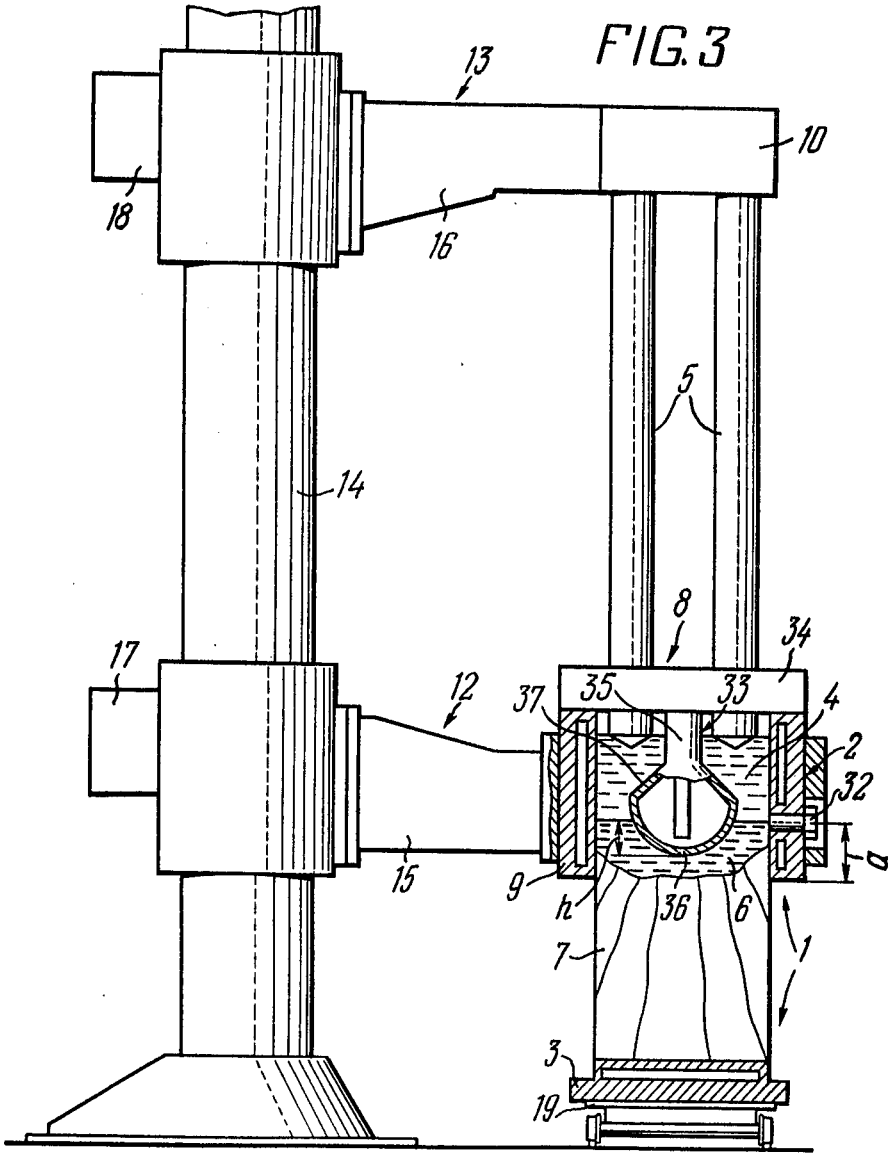
FIG. 3 is a partially cut-away diagrammatic view of another electroslag remelting apparatus for producing an ingot according to the method of the invention.
Figure 6:
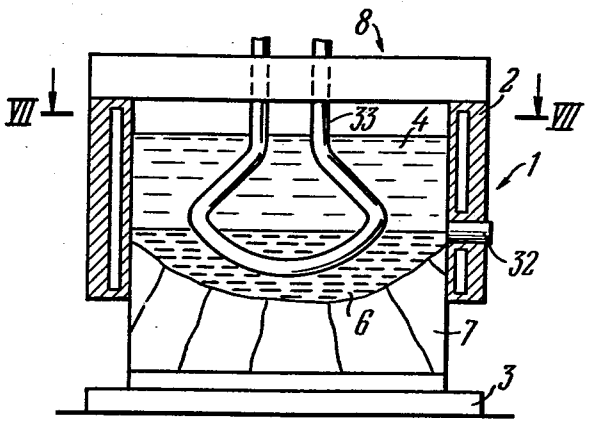

FIG. 3 illustrates another electroslag remelting apparatus for producing ingots which accomplishes the above-described method. It differs from the apparatus of FIG. 2 in the construction of the cooled body 8 which is made here in the form of an extension 33 fixedly connected to the mold 2 by means of supporting members 34 resting on the top end of the mold 2. The extension 33 is disposed on the vertical axis of symmetry of the melting container 1; the extension length measured from the top end of the mold 2 is less than the height of the mold 2. The extension widens at the bottom; its intermediate portion 37 disposed between its narrow portion 35 and wide portion 36 connects both said portions 35 and 36 and is shaped close to a cone. The wide portion 36 of the extension 33 is arranged below the level a of the liquid metal level detector 32 over the bottom plate 3. Inasmuch as the dimension a predetermines the liquid metal level at which the cooled body 8 becomes immersed to the specified depth h, it must be selected proceeding from the above-mentioned considerations that the metal bath bottom profile at the central portion of the bath should have no sections inclined to a horizontal line at an angle exceeding 45°. As indicated above, the level is determined by calculation or experimentally and depends on the size and chemical composition of the ingot to be produced and on the melting operation conditions.

In the same manner the height h of the wide portion 36 of the extension 33 is found, which height should not exceed 60% of the depth of the metal bath 6 when the liquid metal level in the melting container 1 corresponds to the level a of the detector 32.

The cooled body 8 in the apparatus shown in FIG. 3 is a hollow casting whose inner space communicates with a cooling system (not shown). Other modifications of the cooled body are also possible, some of which are shown in FIGS. 4–9 of the drawings.

The extension 33 of the cooled body 8 may have the form of a pipe grating as shown in FIG. 4 FIGS. 5–9 illustrate the extension 33 in the form of a coil of different configurations: a helical coil (FIG. 5); a flat vertical loop employed for a rectangular mold whose narrow face width is not over 500 mm (FIGS. 6, 7); and a loop having a horizontal portion 38 wherein the bent pipe forms a nearly complete circle (FIGS. 8, 9).

The latter modification is applicable to a circular cross-section mold. As shown in FIG. 8, the horizontal plane S of symmetry of the loop portion 38 lies at the level a of the liquid metal level detector 32. The plane may also lie somewhat above said level, but not below the latter to avoid freezing of the extension 33 to the crystallizing metal of the ingot. Vertical portions of the loop, inlet one 39 and outlet one 40, are disposed symmetrically with respect to the vertical axis of symmetry of the melting container 1.

The apparatus functions as follows.

When electric current is fed to the consumable electrodes 5 (FIG. 3) lowered into the slag bath 4, molten metal from their ends flows into the melting container 1, forming the metal bath 6.

Rising in the course of the melting operation, the molten metal constituting the metal bath 6 comes into contact with the cooled body extension 33 at first only by the surface of the metal bath 6 and then gradually reaches the level a at which the depth of immersion of the extension 33 equals the specified depth h. At this moment, on a signal from the detector 32, the lifting device 12 starts lifting the mold 2 and the cooled body 8. Inasmuch as the lift proceeds at a speed equal to the melting rate, the depth h of immersion of the extension 33 of the cooled body 8 remains constant over the entire melting operation period. On completion of the melting operation, when the ingot 7 has reached the specified height, the mold 2 with the cooled body 8 still continues moving at the same speed till the mold 2 comes fully outside the height of the solidified ingot. Being shorter than the mold 2, the extension 33 of the cooled body 8 leaves the metal bath 6 before the latter cools down.

The above-disclosed apparatus is simple in construction and may find application in producing large solid-section ingots for which the above-described production technique has been developed well enough and no correction of the position of the detector 32 and of the cooled body 8 in the mold 2 is needed.

It is quite evident to those skilled in the art that the invention is not limited to the above disclosed electroslag remelting apparatus for producing an ingot and that departures may be made therefrom in accomplishing the method of the invention.

For a fuller understanding of the nature of the invention, specific examples of accomplishing the method of the invention are presented below.

EXAMPLE 1

A 1100-mm-diameter, 2300-mm-high cylindrical ingot of steel containing about 0.2% carbon was produced. The melting rate in terms of weight was constant and amounted to about 1000 kg/h which corresponded to a linear speed of V=435 mm/h. When the molten metal level had reached 300 mm, a cooled body was introduced into the metal bath to a depth of 50 mm which amounted to 20% of the bath depth. At the moment of introduction, the greatest angle of inclination to a horizontal line of the bath bottom profile in the central portion within a diameter of 825 mm was 28°.

The bottom profile and the metal bath depth have been both here and hereinafter determined from the graphs in FIG. 10 representing the liquidus isotherms for different moments of the melting operation in making an ingot of a definite size and shape. The isotherms correspond to the melting operation conducted without introducing a cooled body and have been calculated with the known procedure (see the above-mentioned reference to a report in "Special Electro-Metallurgy", Part 1). The numerals at the abscissa axis of each graph denote the ingot radius, and at the ordinate axis, the ingot height (The dimensions are in cm.).

Figure 10A:
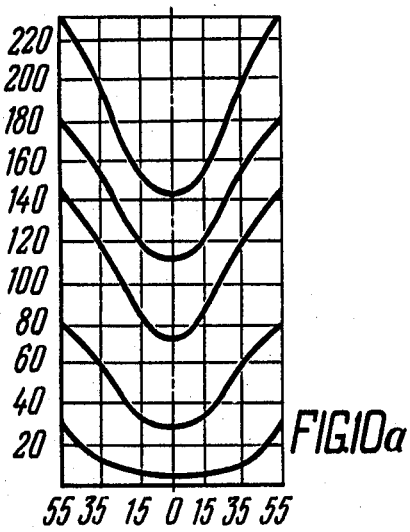
FIG. 10 *a, b, c* represents graphs where calculated liquidus isotherms at different stages of the melting operation for ingots of different sizes and shapes are plotted.

The data for the example being reported have been taken from the graph in FIG. 10*a*. The cooled body whose portion was brought into contact with the molten metal had the form of a truncated cone converging downwardly and measuring dia. 300×dia. 500×350 mm was after immersion moved upwardly at a speed equal to the melting rate. When the molten metal level had reached 2300 mm, the cooled body was rapidly removed out of the metal bath.

The template prepared from the produced ingot exhibited an ordered, fine-grained, compact metal structure with no shrinkage defects. The sulfur print of the molten metal bath bottom has a pronounced protuberance in the central portion.

EXAMPLE 2

In making an ingot of the same size and composition as those in Example 1, the cooled body (the same as in Example 1) was immersed into the molten metal to a depth of 168 mm which constituted 40% of the metal bath depth at the moment when the maximum angle of inclination to a horizontal line of the bath bottom profile in the central portion was 45° and the liquid metal level in the melting container was 800 mm (see FIG. 10*a*).

The cooled body was lifted at a speed equal to the melting rate and was rapidly removed out of the metal bath on completion of the melting operation. No discontinuities in the metal structure in the ingot central portion were found.

EXAMPLE 3

The ingot and the melting operation conditions were the same as in Examples 1 and 2. The cooled body, the same as in the above Examples, was immersed into the metal bath for a depth of 246 mm which constituted 60% of the bath depth at the moment when the liquid metal level in the melting container was 800 mm and the maximum angle of inclination to a horizontal line of the metal bath bottom profile in the central portion of the bath was 45° (see FIG. 10*a*).

Then the cooled body was lifted at a speed equal to the melting rate and was rapidly removed out of the metal bath on completion of the melting operation.

Small deflections from the common direction of crystal growth were observed in the ingot central zone. No segregation and shrinkage defects were found.

EXAMPLE 4

The ingot, the melting operation conditions, and the cooled body were the same as in Examples 1–3. The cooled body was immersed into the metal bath to a depth of 275 mm which constituted 65% of the bath depth at the moment when the liquid metal level in the melting container was 800 mm and the maximum angle of inclination to a horizontal line of the metal bath bottom profile in the central portion of the bath was 45° (see FIG. 10*a*).

Then the cooled body was lifted at a speed equal to the melting rate and was rapidly removed out of the metal bath on completion of the melting operation.

The ingot structure in the central portion was inhomogeneous, crystal growth was disordered, there were zones with oppositely directed crystallization, shrinkage defects, aggregations of non-metallic inclusions.

EXAMPLE 5

The ingot, the melting operation conditions, and the cooled body were the same as in Examples 1–4. The cooled body was immersed into the metal bath to a depth of 275 mm which constituted 40% of the bath depth at the moment when the liquid metal level in the melting container was 1420 mm and the maximum angle of inclination to a horizontal line of the metal bath bottom profile in the central portion of the bath was 55° (see FIG. 10*a*).

Then the cooled body was lifted at a speed equal to the melting rate and was rapidly removed out of the metal bath on completion of the melting operation.

The ingot structure in the central portion was loose, and aggregations of non-metallic inclusions were found.

EXAMPLE 6

The ingot and the melting operation conditions were the same as in Examples 1–5. The melting operation was conducted in the apparatus shown in FIG. 2. The maximum diameter of the float 11 was 500 mm. At the initial moment of the melting operation, the tip 20 of the float 11 bore against the bottom plate 3. When the liquid metal level had reached 300 mm, the float 11 floated up and the depth of its immersion into the metal bath amounted to 100 mm which corresponded to 50% of the bath depth. On completion of the melting operation, the lifting device 12 lifted the float 11 above the liquid metal level.

The metal structure in the ingot central portion was ordered, fine-grained, compact, with no shrinkage defects. The bath bottom had a protuberance in the central portion.

EXAMPLE 7

Figure 4:
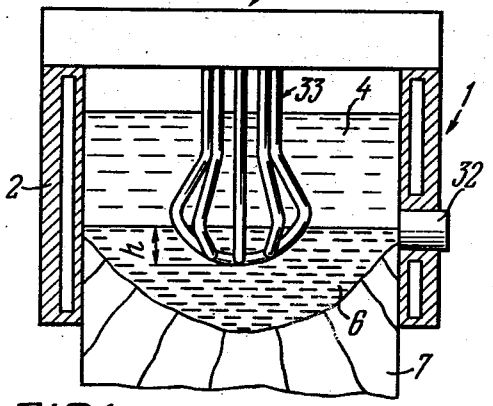
Figure 5:
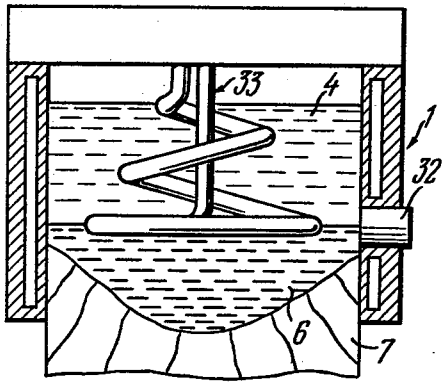

A 2700-mm-diameter, 4430-mm-high cylindrical ingot of 200 t in weight of steel containing about 0.2% carbon was produced in an apparatus of the type shown in FIG. 3, wherein the extension 33 of the cooled body 8 had the form of a pipe grating, as shown in FIG. 4. The melting rate in terms of weight was constant and amounted to 2700 kg/h which corresponded to a linear speed of about 60 mm/h. The liquid metal level detector 32 was installed at a level of a=1200 mm from the bottom plate 3. The wide portion 36 of the extension had the form of a spherical segment with a radius of curvature of 2400 mm. The diameter of the portion was 1900 mm, and the height 360 mm, which conditioned immersion of the cooled body 8 at the moment when the surface of the metal bath 6 had reached a level of 1200 mm to a depth of h=360 mm constituting 60% of the metal bath depth corresponding to said level in an ingot of the same size produced without introducing a cooled body (see FIG. 10*b*).

The maximum angle of inclination to a horizontal line of the bottom profile of the metal bath 6 in its central portion within a diameter of 2025 mm was 35° at said moment.

On completion of the melting operation, moving the mold 2 and the cooled body 8 at a speed equal to the melting rate continued until the mold 2 was removed outside the height of the ingot.

The template prepared from the produced ingot exhibited a compact, fine-grained, ordered metal structure with no segregation and shrinkage defects. The metal bath bottom in the ingot central portion was shaped as a shallow funnel.

EXAMPLE 8

Figure 7:
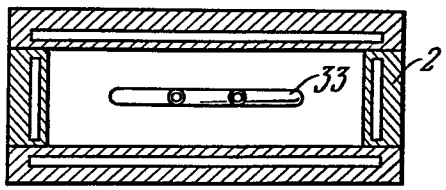

A 250×1100-mm-section, 1500-mm-high rectangular ingot of 4 t in weight of steel containing about 0.2% carbon was produced in an apparatus of the type shown in FIG. 3 with the cooled body 8 of the form shown in FIG. 7. The melting rate in terms of weight was constant and amounted to 1330 kg/h which corresponded to a linear speed of about 500 mm/h.

The liquid metal level detector 32 was installed at a height a=200 mm from the bottom plate 3. The maximum size of the extension 33 of the cooled body 8 at the wide portion was 500 mm measured in parallel to a wide face of the mold).

Figure 10C:
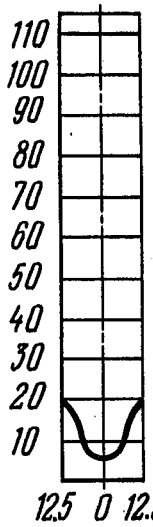
Figure 10B:
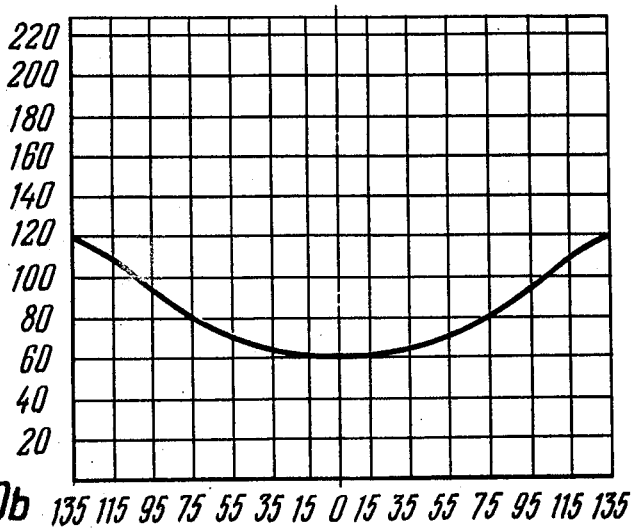

The height h of the wide portion 36 of the extension 33 was 90 mm, which conditioned immersion of the cooled body 8 at the moment when the surface of the metal bath 6 had reached a level of 200 mm to a depth of h=90 mm constituting 60% of the metal bath depth corresponding to said level in an ingot (of the same size produced without immersing a cooled body (see FIG. 10*c*). The maximum angle of inclination to a horizontal line of the bottom profile of the bath in its central portion (within an area measuring 188×825 mm) was 45° at said moment.

On completion of the melting operation, moving the mold 2 and the cooled body 8 at a speed equal to the melting rate continued until the mold 2 was removed outside the ingot.

The ingot was cut along the vertical axis of symmetry of the wide face.

The metal structure was fine-grained, compact, ordered, with no discontinuities.

The above-disclosed method and apparatus for producing solid-section ingots by electroslag remelting ensure a high quality of the produced ingots, being at the same time simpler and more economically efficient than the prior art methods and apparatus of the same purpose which allow obtaining the metal of the same quality as a result of a controlled action upon the ingot crystallization process.

While particular embodiments of the invention have been shown and described, various modifications thereof will be apparent to those skilled in the art. Various other modifications may also be made in the invention without departing from the spirit and scope thereof as defined in the claims.

What is claimed is:

1. A method for producing a solid-section ingot by electroslag remelting, including:

remelting at least one consumable metal electrode in a slag bath in a melting container to form in said container a molten metal bath progressively crystallizing into an ingot so that the interface between the crystallized metal and the molten metal constituting the metal bath forms the bottom of the bath, the slag-metal bath interface moving upwardly as the molten metal is fed into the melting container;

bringing a cooled body into contact with the molten metal constituting the metal bath so that said cooled body is disposed on the vertical axis of symmetry of said melting container;

maintaining said cooled body in contact with the molten metal till the melting operation is complete by moving said cooled body upwardly at a speed close to a predetermined solidifying rate to avoid contact with the crystallized metal; and removing said cooled body from the metal bath after the melting operation is complete.

2. A method according to claim 1, wherein said cooled body is brought into contact with the molten metal prior to the moment when sections inclined to a horizontal line at an angle of 45° are formed in the profile of the metal bath bottom and when such sections appear within the zone, the transverse dimensions thereof on the metal bath surface amount to not less than 75% of said surface; said zone being normally symmetrical with respect to the vertical axis of symmetry of the melting container.

3. A method according to claim 1, wherein said cooled body is immersed into the molten metal bath to a depth not exceeding 60% of the maximum depth of said bath which it had prior to the moment of immersion of said cooled body therein.

4. A method according to claim 1, wherein said cooled body is immersed into said molten metal bath till it momentarily thrusts against the bath bottom and thereafter said cooled body is moved upwardly at a speed exceeding the melting rate to a predetermined level, whereat the depth of immersion of said cooled body into the metal bath does not exceed 60% of the maximum depth of the metal bath which it had prior to the moment of immersion, of said cooled body therein following which said cooled body is moved upwardly at a speed close to the predetermined solidifying rate.

5. An electroslag remelting apparatus for producing solid-section ingots by remelting at least one consumable metal electrode in a slag bath, comprising:

a bottom plate;

a movable open-ended mold defining an inner space therein and disposed over said bottom plate for vertical movement and supported in its lowermost position on said bottom plate, forming therewith a melting container;

a lifting device installed adjacent said melting container and operatively connected with said movable mold;

a lever having a first arm, a second arm, and a pivot pin disposed between the first and the second arm, the pivot pin being secured to said mold on the outside thereof so that the first arm is disposed substantially in the zone over the inner space of said mold and the second arm is disposed beyond said zone;

a cooled body disposed substantially on the vertical axis of symmetry of said melting container and being a float whose weight is heavier than that of the molten slag having a volume equal to that of the float and lighter than that of the molten metal having the same volume, said float being hinged to the end of the first arm of said lever; and a counterweight installed on the second arm of said lever and adapted for movement along said lever to adjust the depth of immersion of said float into the metal bath of the ingot being made.

6. An electroslag remelting apparatus for producing a solid-section ingot by remelting at least one consumable metal electrode in a slag bath, comprising:

a bottom plate;

a movable open-ended mold defining an inner space therein and disposed over said bottom plate for vertical movement and supported in its lowermost position on said bottom plate and forming therewith a melting container;

a lifting device installed adjacent said melting container and operatively connected with said movable mold;

a liquid metal level detector installed in the wall of said movable mold commands wherefrom ensure the controlling of the vertical movement of said movable mold in accordance with the movement of the slag-metal interface relative to the detector in the course of the melting operation; and a cooled body disposed inside said movable mold on the vertical axis of symmetry of said melting container, said cooled body comprising supporting members secured to the top end face of said movable mold and an extension projecting downwardly from said end face for a length less than the height of said movable mold, the extension of said cooled body including a wide portion disposed below the level of said liquid metal level detector, a narrow portion disposed above said wide portion, and an intermediate portion whose surface is shaped similar to a cone and connects said narrow and wide portions, thereby providing for flow of molten metal drops down from the surface of said cooled body.

7. An apparatus according to claim 6, wherein said extension of said cooled body is made in the form of a grating composed of pipes.

8. An apparatus according to claim 6, wherein said extension of said cooled body is made in the form of a coil.

9. An apparatus according to claim 8, wherein said coil is a pipe bent in the form of a loop.

10. An apparatus according to claim 9, wherein said pipe bent in the form of a loop has a horizontal portion where said pipe is bent substantially circlewise and vertical inlet and outlet portions disposed symmetrically with respect to the vertical axis of symmetry of said melting container, the horizontal plane of symmetry of said horizontal portion of said loop being disposed not lower than the level of said liquid metal level detector, which prevents freezing of said cooled body to the crystallizing metal of the ingot.

11. An apparatus according to claim 5, wherein said cooled body comprises supporting members secured to the top end face of said movable mold, and an extension projecting downwardly from said end face for a length less than the height of said movable mold, the extension of said cooled body including a wide portion disposed below the level of said liquid metal level detector, a narrow portion disposed above said wide portion, and an intermediate portion whose surface is shaped similar to a cone, and connects said narrow and wide portions, thereby providing for flow of molten metal drops down from the surface of said cooled body.

12. An electroslag remelting apparatus for producing a solid-section ingot by remelting at least one consumable metal electrode in a slag bath, comprising:

a bottom plate;

an open-ended mold defining an inner space therein and supported on said bottom plate and forming therewith a melting container;

a cooled body disposed substantially on the vertical axis of symmetry of said melting container and being a float whose weight is heavier than that of the molten slag having a volume equal to that of the float and lighter than that of the molten metal having the same volume;

a lever mounted above said mold for rocking with respect to the latter and having a first arm and a second arm, the first arm of said lever being disposed substantially in the zone over the inner space of said mold and having its end connected with the float, a counterweight operatively associated with said second arm for movement along said lever, and said second arm of said lever being disposed beyond said zone; and a lifting device installed close to said melting container and connected with said open-ended mold and with said cooled body, which provides for raising the open-ended mold upward during the melting operation and for removing the cooled body from the metal bath when the melting operation is complete.

13. A method according to claim 12 wherein said cooled body is heavier in weight than that of the molten slag displaced by the portion of the cooled body which is immersed into the slag bath when said cooled body is immersed into the metal bath, but lighter in weight than the weight of the molten metal displaced by the portion of the cooled body which is immersed into the metal bath.

14. A method according to claim 12 wherein the cooled body is moved at a speed approximately equal to the melting rate.

* * * * *